United States Patent [19]

Trimborn

[11] Patent Number: 4,590,787

[45] Date of Patent: May 27, 1986

[54] SCREW PRESS

[75] Inventor: Hermann-Josef Trimborn, Monheim, Fed. Rep. of Germany

[73] Assignee: SMS Hasenclever Maxchinenfabrik GmbH, Dusseldorf, Fed. Rep. of Germany

[21] Appl. No.: 753,166

[22] Filed: Jul. 9, 1985

[30] Foreign Application Priority Data

Jul. 10, 1984 [DE] Fed. Rep. of Germany ..... 3425332

[51] Int. Cl.[4] ..... B21D 22/00

[52] U.S. Cl. ..... 72/454; 72/360; 72/466

[58] Field of Search ..... 72/454, 352, 354, 360, 72/465, 466; 100/270

[56] References Cited

U.S. PATENT DOCUMENTS

| | | | |
|---|---|---|---|
| 3,534,581 | 10/1970 | Mullen | 72/454 |
| 3,595,163 | 7/1971 | Baumann | 100/270 |
| 3,786,743 | 1/1974 | Dischler | 72/454 |
| 3,830,615 | 8/1974 | Walchuelter | 72/454 |
| 4,191,044 | 3/1980 | Grigorenko | 72/454 |

*Primary Examiner*—Leon Gilden

*Attorney, Agent, or Firm*—Holman & Stern

[57] ABSTRACT

A slide is vertically movable in a press frame and supports the upper die. A threaded main spindle is operative between the press frame and the slide. A clutch disc connected rationally rigidly to the spindle is connectable by friction contact to a driven disc flywheel for the operating stroke of the slide. Piston-cylinder units act between the press frame and the slide for returning the slide to the starting position. The spindle is axially clamped between two spring columns, one of which acts between one end of the spindle and the slide and the other of which acts between the other end of the spindle and a counter thrust bearing axially fixed in the press frame. An auxiliary spindle, of approximately the same lead but with a smaller diameter, engages in an internally threaded bore in the main spindle and is disposed between the corresponding end of the main spindle and the corresponding spring column in order to compensate the relative axial movement between the axially fixed main spindle and the axially movable slide or between the main spindle axially movable with the slide and the counter thrust bearing held axially movably but rotationally rigidly in the slide or on the counter thrust bearing against the force exerted upon it by the spring column.

9 Claims, 7 Drawing Figures

SCREW PRESS

BACKGROUND TO THE INVENTION

1. Field of the Invention

This invention relates to screw presses.

2. Prior Art

Known screw presses comprise a press frame, a slide which is vertically movable in the press frame and supports the upper die, a threaded spindle operative between the press frame and the slide, a driven disc flywheel and a clutch disc which is connected rotationally rigidly to the spindle and can be connected by friction contact to the flywheel for the operating stroke of the slide, and piston-cylinder units acting between the press frame and the slide for returning the slide to the starting position.

In this connexion the spindle can be supported in an axial bearing in the upper crossbar of the press frame, the threaded shaft of the spindle engaging in a threaded nut in the slide. It is also possible, however, for a threaded nut, into which the threaded shaft of the spindle engages, to be inserted into the upper crossbar of the press shaft, a thrust bearing then being provided between the lower end of the spindle and the slide.

At each operating stroke of screw presses of this type the continuously driven flywheel is connected to the clutch disc by actuation of a friction clutch, as a result of which the spindle connected rotationally rigidly to the clutch disc is rotated. As the spindle rotates, the slide—depending upon its design—is pushed down by the threaded shaft by way of the threaded nut inserted therein or by the descending spindle by way of a thrust bearing in the slide. Depending upon the forging requirements the friction clutch is lifted again as a function of its force or its path. The slide is then moved back into the starting position by the piston-cylinder units which are operative between the press frame and the slide and which are acted upon hydraulically or pneumatically, and the spindle provided with a lead above the automatic lock rotates back.

Both during the execution of the forging blow and during the return movement of the slide with returning rotation of the spindle derived therefrom, the flanks which are always the same bear against one another in the threaded nut and on the threaded shaft and in the multiple-collar thrust bearing and on the collar pin or in the thrust bearing, as a result of which difficulties arise during lubrication. In order to eliminate such difficulties, correspondingly expensive lubricating apparatus and arrangements are required to supply lubricant under high pressure to all the sliding surfaces.

It would therefore be desirable to be able to ensure reliable lubrication with simple means.

SUMMARY OF THE INVENTION

The invention provides a screw press in which the change in the flank abutment between the loaded and non-loaded operating state of the screw press is carried out while using the thread and bearing clearance in such a way that the spindle is axially clamped between two spring columns, one of which is disposed acting between one end of the spindle and the slide and the other of which is disposed acting between the other end of the spindle and a counter thrust bearing axially fixed in the press frame, and an auxiliary spindle is additionally provided which has approximately the same lead with a smaller diameter as the main spindle and engages in an internally threaded bore in the main spindle and which is disposed between the corresponding end of the spindle and the corresponding spring column in order to compensate the relative axial movement between the axially fixed main spindle and the axially movable slide or the main spindle axially movable with the slide and the counter thrust bearing and is held axially movably but rotationally rigidly in the slide or on the counter thrust bearing respectively against the force exerted upon it by the column of springs.

The force operating in the spring columns amounts to only 1% or less of the force which occurs during a forging blow, i.e. the spring columns are compressed by the operating force and the upper flanks of the collar or thread turns of the spindle bear in the collar bearing or in the spindle nut in the upper crossbar of the press frame and the lower flanks of the threads or the bearing surfaces of the thrust bearing of the spindle bear in the threaded nut or in the thrust bearing in the slide. The spring columns are therefore ineffective under the operating force. When the press is relieved of pressure, however, the spring columns effect the change in the flank abutment as sought according to the invention, as the spring column disposed in the slide pushes the slide downwards from the spindle so that the upper flanks of the threads of the spindle come to bear in the threaded nut or the bearing surface in the thrust bearing in the slide is raised, while the spring column supported in an axially fixed manner on the counter thrust bearing and thus in the press frame pushes the spindle downwards until the lower flanks of the tooth or threads abut in the collar bearing or in the threaded nut in the upper crossbar of the press frame.

It is evident that the force of the lower spring column must be greater than the force of the return piston minus the weight of the slide and the force of the upper sring column must be somewhat greater than the force of the lower spring column minus the weight of the spindle, the forced exerted by the return piston having to be sufficient to bear the weight of the slide and the spindle and to accelerate in order to return in the short time desired. Under the action of the force exerted by the return pistons upon the spring columns the auxiliary spindle prevented from rotating effects a returning rotation of the main spindle while at the same time the slide returns to the starting position in which the foot or head member of the auxiliary spindle then bears on the threaded nut in the cavity of the main spindle and also eliminates an additional returning rotation of the main spindle. It is evident that the direction of loading on the thread flanks and the collar pin flanks or in the thrust bearing changes only under the heavy loading of the forging below, so as to ensure an oil film sufficient for the brief heavy loading of the flanks or the bearing surfaces for the hydrostatic lubrication on the said surfaces.

In addition to this substantial advantage there is the further advantage that the auxiliary spindle, the lead of which is equal at a smaller pressure to the lead of the main spindle, can produce the returning rotation of the main spindle more effectively with its greater lead than was formerly possible by the direct conversion of the restoring force on the spindle with the lower leads.

If the screw press is provided with a main spindle which is supported in an axial bearing, for example a collar bearing in the upper crossbar of the press frame and the threaded shaft of which engages in a threaded nut in the slide, in a preferred embodiment the threaded shaft of the main spindle is provided with a bore and a threaded nut is inserted in the lower end of the bore and the auxiliary spindle engaging in the said threaded nut is inserted in a guide on the base of the slide so as to be prevented from rotating by a foot member, the spring column being disposed between the base of the slide and the foot member of the auxiliary spindle.

If the screw press in the upper crossbar of the press frame is provided with a threaded nut in which the main spindle with its threaded shaft engages, in a preferred embodiment the upper end of the main spindle is provided with a bore, and a threaded nut is inserted in the bore and the auxiliary spindle engaging in the threaded nut is inserted in a guide on a bearing support to the press frame so as to be prevented from rotating by a head member, the spring column being disposed between the bearing support and the head member of the auxiliary spindle.

From the structural point of view it is particularly simple and involves little outlay if stacks of cup springs with adjustable pre-stressing are used as the spring columns.

In order to be able to set and regulate the force and action of the spring columns to a substantial extent, however, it is preferable for that piston-cylinder units to be provided as the spring columns and, in particular, their piston is formed by the foot member or head member respectively of the auxiliary spindle and their cylinder is inserted in the base of the slide or in the bearing support to the press frame, it being possible to set and/or regulate the biassing of the piston with pressure medium. It is then advantageous, to connect the cylinder space with a pressure reservoir space.

The lead of the auxiliary spindle should be approximately equal to that of the main spindle, slight differences being compensated by the spring column supporting the auxiliary spindle. In order to be able to reverse the direction of rotation of the main spindle and to return the spindle together with the slide into the starting position as rapidly as possible after a forging blow and the uncoupling from the flywheel have taken place, the auxiliary spindle is produced with a somewhat greater lead than the main spindle so that during the operating stroke of the screw press the stressing in the spring column supporting the auxiliary spindle may be reinforced and thus a greater force is available for reversing the direction of rotation.

The invention will be described further, by way of example only, with reference to the accompanying drawings.

DESCRIPTION OF PREFERRED EMBODIMENTS

Figure 1:
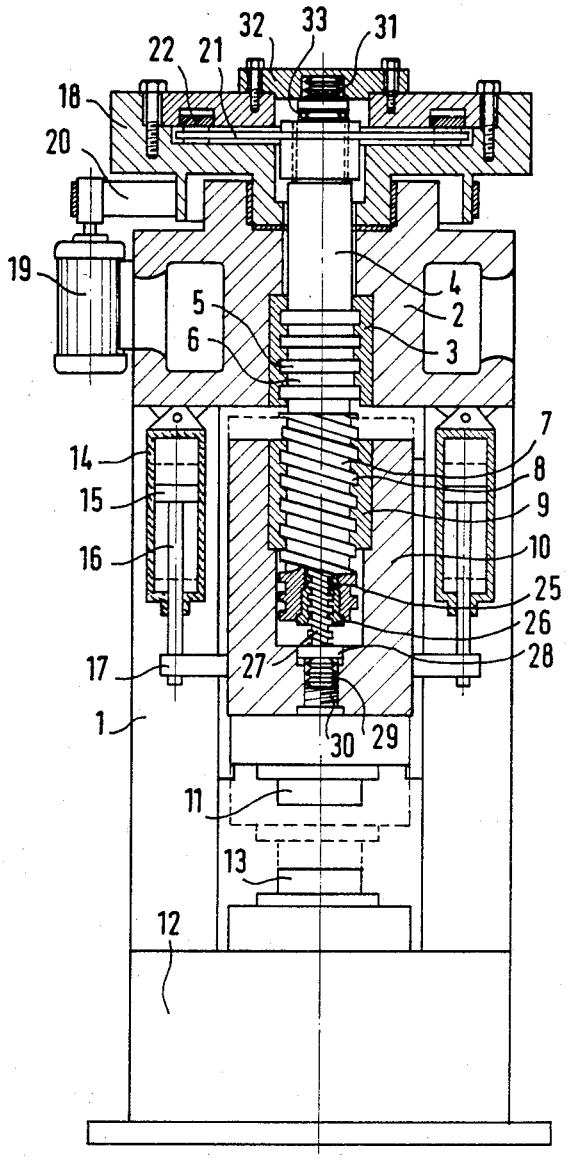
FIG. 1 shows a screw press with an axially fixed spindle, in axial section.
Figure 2:
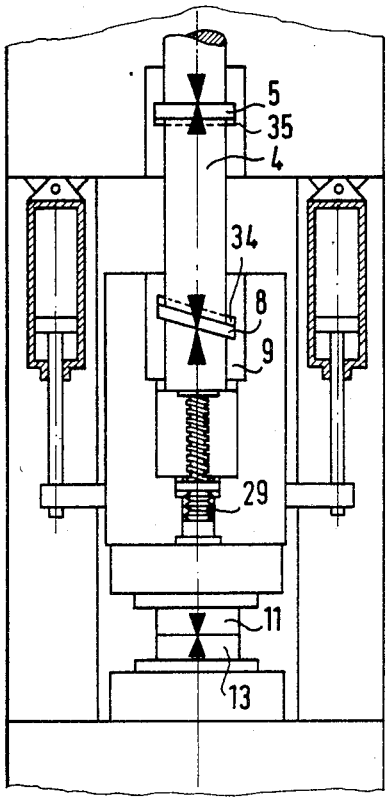
FIG. 2 diagrammatically illustrates the press in the operating position during a forging blow.
Figure 3:
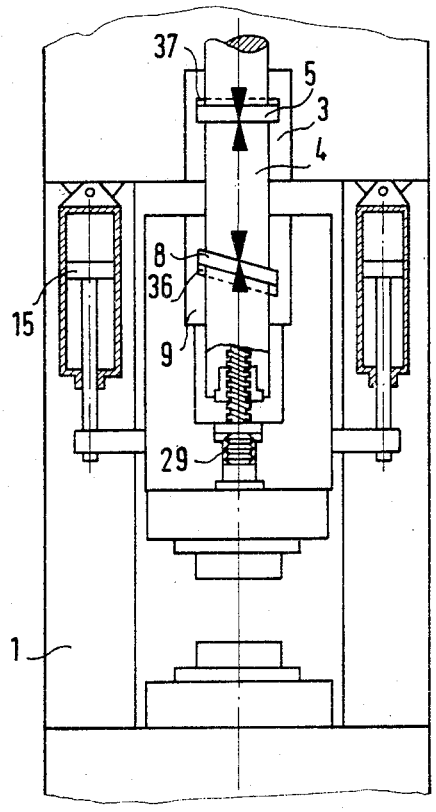
FIG. 3 diagrammatically illustrates the press in an operating position during the return movement of the slide into the starting position.

The screw press illustrated in FIGS. 1 to 3 has a press frame 1. A multiple-collar thrust bearing sleeve 3, in which the spindle 4 is supported by collars 5 of the collar journal 6, is inserted in the upper crossbar 2 of the press frame 1. The spindle 4 is provided with a threaded shaft 7, whose threads 8 engage in a threaded nut 9 in the slide 10. The slide 10, which supports an upper die 11, is guided in the press frame 1 so as to be vertically movable. The lower crossbar 12 of the press frame 1 supports a lower die 13. Cylinders 14 accommodate pistons 15 with piston rods 16 which hold the slide 10 by way of claws 17 and return it to the starting position after a forging blow; the cylinders 14 are secured to the upper crossbar 2 of the press frame 1. The spindle 4 is driven by a disc flywheel 18 which is rotated by a motor 19 by way of a drive belt 20. A clutch disc 21, which is rotationally rigidly connected to the spindle 4 and is connected by friction contact to the flywheel 18 by acting upon an annular piston 22 in the said flywheel 18, is provided for the drive connexion. By rotating the spindle 4 with the flywheel 18 the slide 10 together with the upper die 11 is brought to strike against the lower die 13 in order to execute a forging blow (cf. also FIG. 2, which shows this operating position).

The threaded shaft 7 of the spindle 4 has a bore 25 in which and a threaded nut 26 is inserted. An auxiliary spindle 27, which is provided with a thread in the same direction as the thread of the threaded shaft 7 of the main spindle 4 and having the same lead, engages in the threaded nut 26. The auxiliary spindle 27 is provided with a foot member 28, in the form of a square for example, by which it is guided rotationally rigidly but axially movably in the recess 29 in the base of the slide 10. The foot member 28 is supported on a spring column 29 which is formed from a stack of pre-stressed cup springs and is held by a closure member 30 for the receiving bore in the base of the slide 10. The spring column 29 acts against a spring column 31 which is likewise formed from a stack of pre-stressed cup springs. The spring column 31 is supported in a recess in the cover 32 closing the flywheel 18 and presses upon the upper end of the spindle 4 by way of the axial bearing 33. Since the weight of the flywheel 18 is greater than the force to be applied by the spring column 31, it is unnecessary to secure the flywheel 18 axially at the top by a special counter thrust bearing, which is replaced by the axial bearing 33 in the cover 32 of the flywheel 18.

FIG. 2 diagrammatically illustrates the conditions during the loading of the forging blow, in which the upper die 11 and the lower die 13 touch one another. The forging force has compressed the spring columns 29 and 31 to such an extent that the threads 8 bear with their lower flanks on the threaded nut 9 and the flank clearance 34 occurs above the threads 8, and that the collar threads 5 bear with their upper flanks on the collar bearing sleeve 3 and the flank clearance 35 occurs below the collar threads 5.

As soon as the forging blow has finished and the annular piston 22 is relieved of pressure the spindle 4 is free to rotate back. This is effected by the stress which is stored in the spring columns 29 and 31 and is maintained by the return piston 15. As soon as the press frame 1 is relieved, the spring column 29 effects a change in the abutment of the flanks of the threads 8 in the threaded nut 9, so that the clearance 36 now occurs below the threads 8, while the spring column 31 effects a change in the abutment of the flanks of the tooth threads 5 in the collar bearing sleeve 3, so that the clearance 37 now occurs above the collar threads 5.

Under the action of the spring columns 29 tensioned by the return pistons 15 the auxiliary spindle 27 prevented from turning in the slide 10 exerts an axial force and a torque with its threads upon the spindle 4, the axial force being absorbed by the spring column 31, while the torque leads to a returning rotation of the spindle 4, until the auxiliary spindle 27 is completely screwed into the threaded nut 26 and the foot member 28 has come to bear against the threaded nut 26, so that the force of the spring column 29 is completely absorbed by the spring column 31.

If the clutch disc 21 is once more coupled to the flywheel 18, the auxiliary spindle 27 is again screwed out of the threaded nut 26 and pushes the slide 10 in front of it by way of the spring column 29 until the spring columns 29 and 31 are compressed by a further forging blow and the change in the flank abutment on the threads and collar bearing threads 8 is effected and the operating position illustrated in FIG. 2 is produced.

Figure 4:
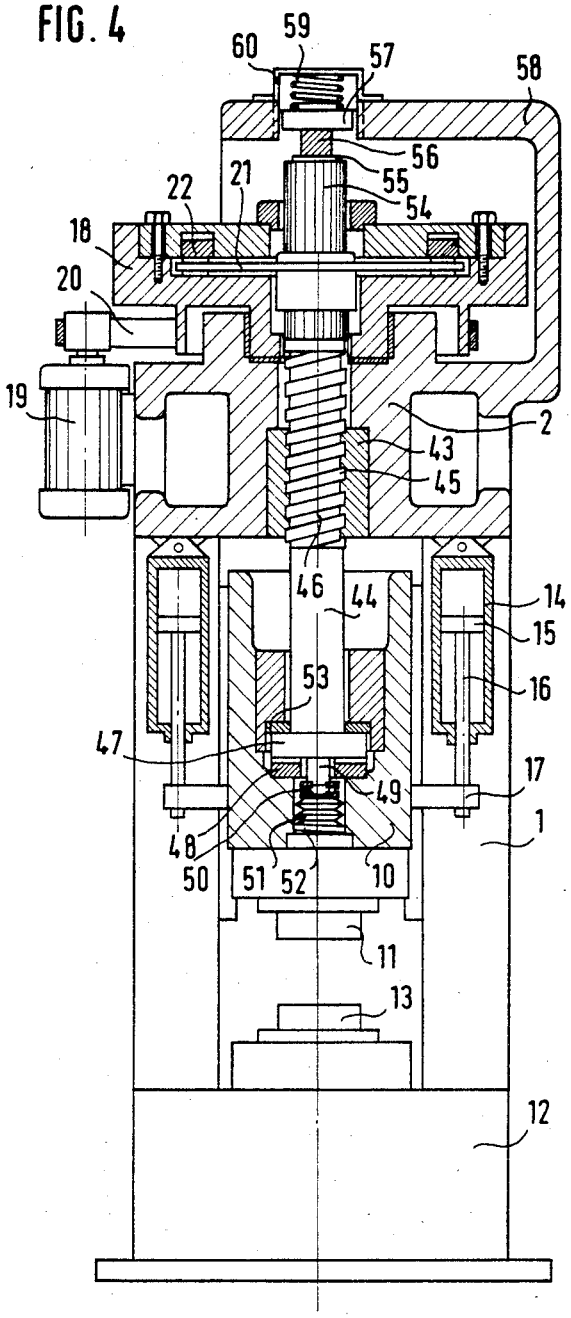
FIG. 4 shows a screw press with an axially movable spindle, in axial section.
Figure 5:
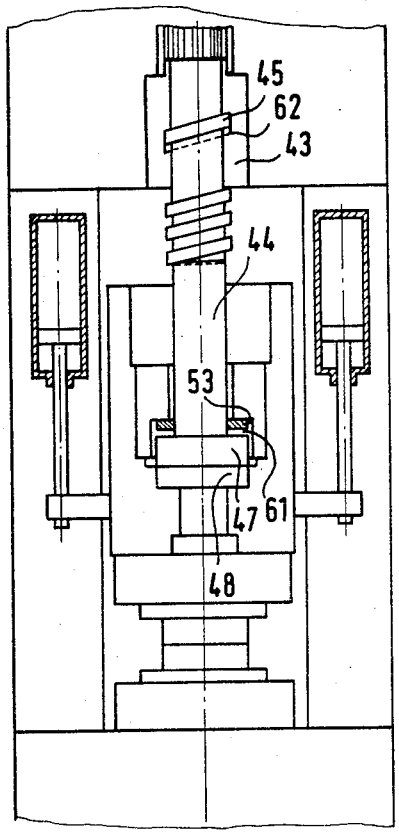
FIG. 5 diagrammatically illustrates the press of FIG. 4 in the operating position during a forging blow.
Figure 6:
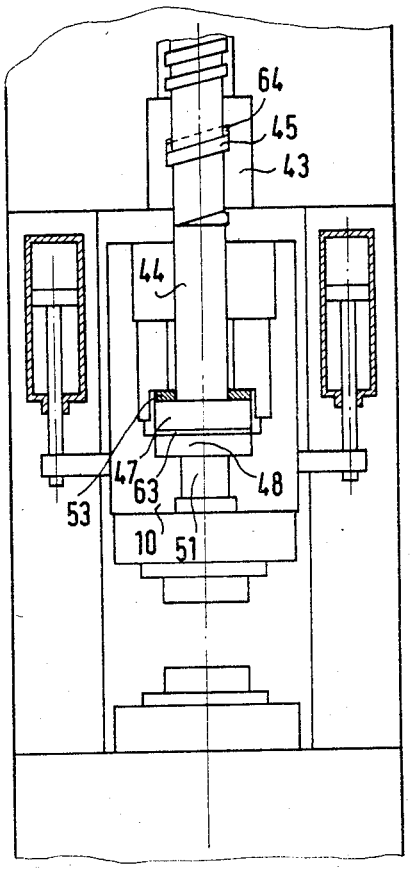
FIG. 6 diagrammatically illustrates the press of FIG. 4 in an operating position during the return of the slide into the starting position.

A further embodiment is illustrated in FIGS. 4 to 6. Where components corresponding to one another are present in the first and the further embodiment, these components are designated similarly and a repetition of their description is dispensed with. In this embodiment the upper crossbar 2 of the press frame 1 is provided with a threaded nut 43. A spindle 44 engages with threads 45 on its threaded shaft 46 in the threaded nut 43. The spindle 44 is provided with a wheel flange 47 at its lower end. A thrust bearing 48 in the slide 10 to transmits the force exerted by the spindle 44 from the wheel flange 47 to the slide 10. A pin 49 at the lower end of the spindle 44 extends through the bore in the thrust bearing 48 and supports the spindle 44 on a spring column 51 below the thrust bearing 48 by way of an axial bearing 50. The spring column 51 is mounted in a recess in the base of the slide 10 and closed by a closure member 52. The wheel flange 47 is axially secured in the slide 10 between the thrust bearing 48 and an additional axial bearing 53 with slight axial play. Above the threaded shaft 46 the spindle 44 is provided with a splined pin 54 for the rotationally rigid but axially movable connexion of the spindle 44 to the clutch disc 22 which (contrary to the embodiment according to FIG. 1 in which only the compensation of the clutch and bearing play is necessary) in the embodiment according to FIG. 4 must compensate the entire spindle stroke. In the region of the splined pin 54 the spindle 44 has a bore and a threaded sleeve 55 is inserted into the upper end of the bore. An auxiliary spindle 56 is provided which engages in the threaded sleeve 55 and has a head member 57. The head member 57 of the auxiliary spindle 56 is guided rotationally rigidly but axially movably in a bearing support 58 connected to the upper crossbar 2 of the press frame 1. A spring column 59 held by a cap 60 in the bearing support 58 presses upon the auxiliary spindle 56.

In the operating position illustrated in FIG. 5, during the execution of a forging blow the thrust bearing 48 in the slide 10 bears on the wheel flange 47 of the spindle 44, while conversely a clearance 61 is present between the wheel flange 47 and the axial bearing 53. The threads 45 bear with their upper flank on the threaded nut 43 and the clearance 62 is present below the lower flank.

The spring column 51 otherwise (see FIG. 6) presses the slide 10 from the wheel flange 47 of the spindle 44, so that the axial bearing 53 bears on the wheel flange 47, while a clearance 63 is present between the thrust bearing 48 and the wheel flange 47. The spring column 59 presses the spindle 44 downwards by way of the auxiliary spindle 56 against the force of the spring column 51 (see FIG. 4), so that the threads 45 bear with their lower flanks on the threaded nut 43 and the clearance 64 is produced above the upper flanks of the threads 45. The force exerted by the spring column 59 upon the auxiliary spindle 56 produces an axial force and a torque which rotates the spindle 44 backwards.

Figure 7:
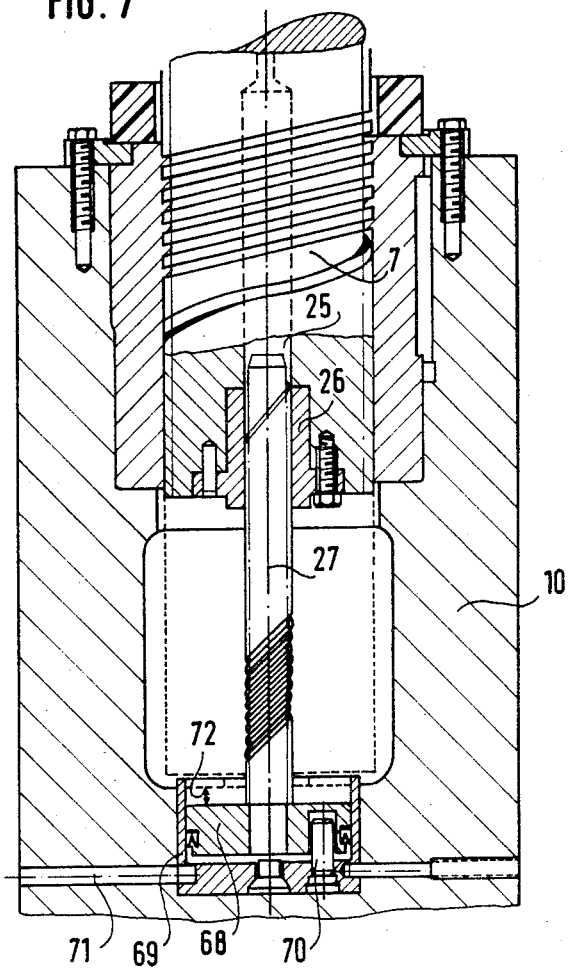
FIG. 7 is a cut-away view of a modification of the screw press according to FIG. 1.

A modification of the embodiment according to FIG. 1 is shown in a cut-away view in FIG. 7. Here too the same reference numerals are used for parts corresponding to one another. The threaded shaft 7 of the spindle shown in the cut-away view has a bore 25 which receives the threaded sleeve 26 for the auxiliary spindle 27. The slide is designated 10. The modification lies in the fact that, in the case of the embodiment according to FIG. 7, a unit formed by a piston 68 (forming the foot member of the auxiliary spindle 27) and by a cylinder 69 is provided as the spring column. The cylinder 69 is secured in a recess in the base of the slide 10. A pin 70 prevents the piston 68 and thus the auxiliary spindle 27 from rotating. The inner space of the cylinder 69 is connected by way of a duct 71 to a pressure reservoir (not shown) at which the pressure effective in the cylinder 69, i.e. the effective pressure of the spring column, is set and regulated. In this embodiment the lead of the auxiliary spindle 27 is slightly greater than that on the threaded shaft 7 of the spindle, so that the piston 68 executes a stroke 78 during the stroke of the slide 10. The greater force of the spring column available at the beginning of the returning rotation of the spindle results in a corresponding torque and thus accelerates the returning rotation of the spindle.

I claim:

1. A screw press comprising a press frame, a slide which is vertically movable in the press frame and supports the upper die, a threaded main spindle operative between the press frame and the slide, a driven disc flywheel and a clutch disc which is connected rotationally rigidly to the main spindle and is connectable by friction contact to the flywheel for the operating stroke of the slide, piston-cylinder units acting between the press frame and the slide for returning the slide to the starting position, first and second spring columns between which the main spindle is axially clamped, the first spring column acting between one end of the main spindle and the slide, the second spring column acting between the other end of the main spindle and a counter thrust bearing axially fixed in the press frame, and an auxiliary spindle of approximately the same lead as the main spindle but with a smaller diameter, which engages in an internally threaded bore in the main spindle and is disposed between the corresponding end of the main spindle and the corresponding spring column in order to compensate the relative axial movement between the axially fixed main spindle and the axially movable slide or between the main spindle axially movable with the slide and the counter thrust bearing held axially movably but rotationally rigidly in the slide or on the counter thrust bearing against the force exerted upon it by the spring column.

2. The screw press of claim 1, in which the main spindle is supported in an axial bearing in an upper crossbar of the press frame and has a threaded shaft which engages in a threaded nut in the slide, the threaded shaft of the main spindle having a bore, a threaded nut being inserted in the lower end of the bore, the auxiliary spindle engaging in the latter threaded nut and being inserted in a guide on the base of the slide so as to be prevented from rotating by a foot member, the first spring column being disposed between the base of the slide and the foot member of the auxiliary spindle.

3. The screw press of claim 1, further comprising a threaded nut in an upper crossbar of the press frame, in which threaded nut the main spindle with its threaded shaft engages, and a thrust bearing between the lower end of the spindle and the slide, and a rotationally rigid but axially movable connexion of the main spindle to the clutch disc, the upper end of the main spindle having a bore and a threaded nut inserted in the bore, the auxiliary spindle engaging in the latter threaded nut and being inserted in a guide on a bearing support on the press frame so as to be prevented from rotating by a head member, the second spring column being disposed between the bearing support and the head member of the auxiliary spindle.

4. The screw press of claim 1, in which at least one of the spring columns comprises an adjustably pre-stressed stack of cup springs.

5. The screw press of claim 1, in which at least one of the spring columns comprises a piston - cylinder unit.

6. The screw press of claim 5 in which the piston-cylinder unit serving as a spring column comprises a piston formed by an end member of the auxiliary spindle and a cylinder inserted in the base of the slide or in a bearing support on the press frame.

7. The screw press of claim 5, including means for setting or regulating the biassing of the piston with pressure medium.

8. The screw press of claim 7, in which the cylinder space is connected to a pressure reservoir space.

9. The screw press of claim 1, in which the lead of the auxiliary spindle is greater than that of the main spindle.

* * * * *